US010468213B2

(12) United States Patent
Rhein

(10) Patent No.: US 10,468,213 B2
(45) Date of Patent: Nov. 5, 2019

(54) AIR BREAK ELECTRICAL SWITCH HAVING A BLADE TOGGLE MECHANISM

(71) Applicant: Hubbell Power Systems, Inc., Shelton, CT (US)

(72) Inventor: David A. Rhein, St. Jacob, IL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/000,682

(22) Filed: Jun. 5, 2018

(65) Prior Publication Data

US 2018/0286608 A1 Oct. 4, 2018

Related U.S. Application Data

(63) Continuation of application No. 14/818,285, filed on Aug. 4, 2015, now Pat. No. 9,991,072, which is a continuation of application No. 13/979,215, filed as application No. PCT/US2012/021650 on Jan. 18, 2012, now Pat. No. 9,099,266.

(60) Provisional application No. 61/434,263, filed on Jan. 19, 2011.

(51) Int. Cl.

| | |
|---|---|
| ***H01H 31/02*** | (2006.01) |
| ***H01H 31/28*** | (2006.01) |
| ***H01H 31/30*** | (2006.01) |
| ***H01H 31/00*** | (2006.01) |
| ***H01H 1/52*** | (2006.01) |

(52) U.S. Cl.

CPC ..... *H01H 31/026* (2013.01); *H01H 31/28* (2013.01); *H01H 31/30* (2013.01); *H01H 1/52* (2013.01); *H01H 31/00* (2013.01); *H01H 2031/286* (2013.01)

(58) Field of Classification Search

CPC .. H01H 3/32; H01H 3/46; H01H 3/54; H01H 3/60; H01H 15/00; H01H 2001/00; H01H 2001/22; H01H 2001/50; H01H 2031/00; H01H 2031/286; H01H 2031/28; H01H 31/00; H01H 31/026; H01H 31/28; H01H 31/30; H01H 1/12; H01H 1/18; H01H 1/2041; H01H 1/22; H01H 1/225; H01H 1/42; H01H 1/50; H01H 1/52

USPC ..... 200/48 SB

See application file for complete search history.

(56) References Cited

U.S. PATENT DOCUMENTS

| | | | |
|---|---|---|---|
| 2,889,435 | A | 6/1959 | Albright |
| 3,244,827 | A | 4/1966 | Kussmaul |
| 3,504,142 | A | 3/1970 | McKinnon |
| RE27,625 | E | 4/1973 | Weston |

(Continued)

*Primary Examiner* — Anthony R Jimenez

(74) *Attorney, Agent, or Firm* — Michael Best & Friedrich, LLP

(57) ABSTRACT

An electrical switch includes a pivotally supported blade, a toggle mechanism, and an operating mechanism. The operating mechanism is drivable in a first direction to pivot the blade about a first axis and toward a closed blade position. When pivoting toward the closed blade position, the toggle mechanism inhibits the blade from pivoting about a second axis. Upon reaching the closed blade position, continued motion of the operating mechanism in the first direction causes the toggle mechanism to pivot the blade about the second axis toward a closed contact position. In the closed contact position, the blade contacts at least one blade contact to electrically connect the blade and a first electrical terminal.

4 Claims, 13 Drawing Sheets

(56) References Cited

U.S. PATENT DOCUMENTS

| | | | | |
|---|---|---|---|---|
| 3,836,737 | A * | 9/1974 | Redfern | H01H 31/20<br>200/48 A |
| 4,112,268 | A | 9/1978 | Chung | |
| 5,293,012 | A * | 3/1994 | Levi | H01H 31/28<br>200/275 |
| 5,652,419 | A | 7/1997 | Amonett et al. | |
| 5,739,490 | A | 4/1998 | Amonett et al. | |
| 9,099,266 | B2 | 8/2015 | Rhein | |

* cited by examiner

AIR BREAK ELECTRICAL SWITCH HAVING A BLADE TOGGLE MECHANISM

CROSS REFERENCE TO RELATED APPLICATIONS

This application claims the benefit of U.S. patent Ser. No. 14/818,285, filed Aug. 4, 2015, which claims the benefit of U.S. patent Ser. No. 13/797,215, filed Jul. 11, 2013, which claim the benefit of U.S. Provisional Patent Application No. 61/434,263, filed Jan. 19, 2011, the disclosures of which are hereby incorporated by reference in their entirety.

STATEMENT CONCERNING FEDERALLY SPONSORED RESEARCH OR DEVELOPMENT

Not applicable

FIELD OF THE INVENTION

This invention relates to a high voltage/high current air break switch that rotates about multiple axes to engage a distal electrical terminal.

BACKGROUND OF THE INVENTION

High voltage/high current air break switches typically include an elongated conductive contact or "blade" that is locked or otherwise secured to a distal electrical terminal during operation to ensure that the components remain in contact. Relatively large forces must be established and overcome to move the blade into a locking position to assure a stable conductive connection.

Some previous designs provided blades that could be closed by exerting relatively low forces. In some of these designs, rotating an operating mechanism (e.g., and elongated shaft extending to the ground) would first cause the blade to pivot and enter the distal electrical terminal. Continued rotation of the operating mechanism would then pivot the blade about its longitudinal axis and into contact with the electrical terminal to establish the electrical connection.

These low-closing force switches are not without drawbacks, however. In particular, the blades of previous low-closing force switches are capable of pivoting about their longitudinal axis prematurely. There are two common ways in which this can occur. First and when opening the switch, if the blade is rotated quickly and stopped suddenly, the momentum of the blade will overcome the force applied by springs to hold the blade in its open contact position (i.e., its rotational orientation about its longitudinal axis in which it does not contact the electrical terminal) and cause the blade to pivot about its longitudinal axis and stop in the closed contact position. Second and when closing the switch, the blade may initially bounce off the distal electrical terminal and allow the blade to rotate about its longitudinal axis before it is properly seated in the electrical terminal. In both of these cases, the switch cannot be subsequently closed using the operating mechanism.

Therefore, a need exists for an improved air break switch that addresses one or more of the above drawbacks of previous switch designs.

SUMMARY OF THE INVENTION

In one aspect, the present invention provides an electrical switch comprising a frame configured to connect to a utility structure. A first electrical terminal is electrically insulatively supported by the frame, and the first electrical terminal includes at least one blade contact. A blade support housing is electrically insulatively supported by the frame and disposed apart from the first electrical terminal. The blade support housing is pivotally supported so as to be pivotable about a first axis relative to the frame. The blade support housing also supports a blade so as to be pivotable about a second axis relative to the blade support housing. The switch further comprises a toggle mechanism that includes a first toggle member fixedly connected to the blade and a second toggle member movably supported by the blade and pivotally fixed relative to the blade support housing. The toggle mechanism further includes a biasing member forcing the second toggle member to engage the first toggle member. The switch further comprises an operating mechanism connected to the blade through the first toggle member. The operating mechanism is drivable in a first direction to pivot the blade support housing and the blade about the first axis and toward a closed blade position. In the closed blade position, the blade is disposed proximate and engageable with the first electrical terminal. When pivoting toward the closed blade position, the second toggle member engages the first toggle member to inhibit the blade from pivoting about the second axis relative to the blade support housing. Upon reaching the closed blade position, continued motion of the operating mechanism in the first direction causes the first toggle member to slip relative to the second toggle member and thereby pivot the blade about the second axis toward a closed contact position. In the closed contact position, the blade contacts the at least one blade contact to electrically connect the blade and the first electrical terminal.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENT

Figure 1:
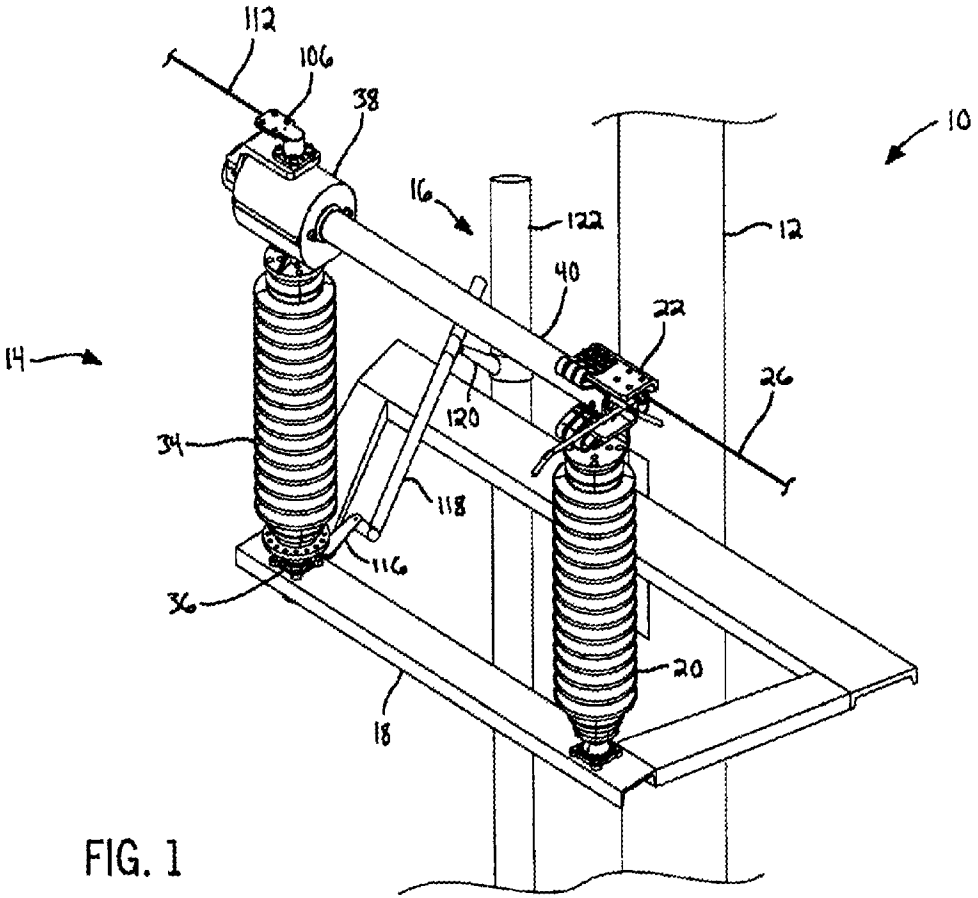
FIG. 1 is a perspective view of a utility structure supporting an air break switch of the present invention in a closed blade position and a closed contact position in which terminals of the switch are electrically connected.

Referring first to FIG. 1, a high voltage/high current electrical or air break switch 10 of the present invention may be supported by many types of appropriate utility structures, such as a utility pole 12. In general, the switch 10 includes one or more upper switches 14 disposed above the ground and an operating mechanism 16 extending from the upper switch 14 toward the ground. The operating mechanism 16 may be driven by an electrical technician on the ground to move the upper switch 14 between different operating positions. Unlike previous switch designs, the present switch 10 includes features that effectively inhibit a conductive blade 40 from prematurely pivoting to a position in which it is configured to contact a distal terminal. These aspects are described in further detail in the following paragraphs.

Referring to FIGS. 1-4, the general structure of the upper switch 14 will first be described. The upper switch 14 includes a support frame 18 fixedly connected to the utility pole 12. The support frame 18 mounts both stationary and pivotable switch components. Regarding the stationary switch components, a first end of the support frame 18 mounts a first elongated insulator 20. The first insulator 20 supports a first electrical terminal 22 above the frame 18 and, as such, the first electrical terminal 22 is electrically isolated from the frame 18.

Referring now to FIGS. 2-6, the first electrical terminal 22 includes a Conductor contact 24 for connection to another electrical conductor, such as a transmission wire 26 (FIG. 1). The electrical terminal 22 also includes one or more terminal contacts 28. The terminal contacts 28 are preferably arranged in upper and lower pairs and each contact 28 in a pair is spring-biased toward the other contact 28 in the pair. The function of the terminal contacts 28 is described in further detail below. A Jock bracket 30 (FIGS. 4 and 5) is disposed between the pairs of the terminal contacts 28. The function of the lock bracket 30 is also described in further detail below.

The first electrical terminal 22 may also include a first arcing arm 32 (FIGS. 4-6) to prevent electrical arcing at the terminal contacts 28. Furthermore, the first electrical terminal 22 may also support a load interrupter (not shown), such as the load interrupter described in U.S. Pat. No. 4,492,835, the disclosure of which is hereby incorporated by reference in its entirety, or one commercially available from Turner Electric Company, Edwardsville, Ill. The first electrical terminal 22 may also support a corona shield (not shown).

Returning to FIGS. 1-4 and regarding the pivotable switch components, the support frame 18 also mounts a second elongated insulator 34 opposite the first insulator 20. The second insulator 34 is pivotably connected to the support frame 18, e.g., via a bearing assembly 36. Furthermore, the second insulator 34 also connects to the operating mechanism 16 and is pivoted thereby as described in further detail below. The second insulator 34 mounts a blade support 38 and an electrically conductive tubular blade 40 that is pivotable to selectively provide an electrical connection with the first electrical terminal 22.

Rotating the operating mechanism 16 pivots the second insulator 34 about a vertical axis. As such, the operating mechanism 16 pivots the blade 40 from a closed blade position (FIG. 1) to an open blade position (FIG. 3) and vice versa. Specifically, pivoting the operating mechanism 16 in a first direction (i.e., clockwise as viewed from above) drives the blade 40 toward the closed blade position, and pivoting the operating mechanism 16 in a second direction (i.e., counter-clockwise as viewed from above) drives the blade 40 toward the open blade position.

Figure 5:
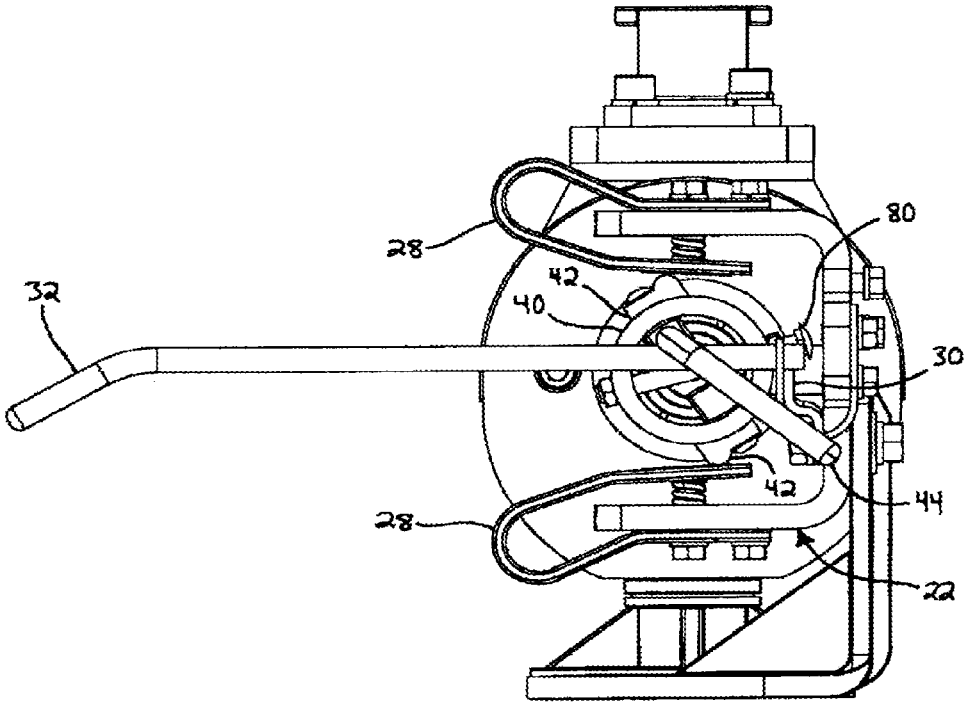
FIG. 5 is a side view of the air break switch moving toward the open contact position.
Figure 6:
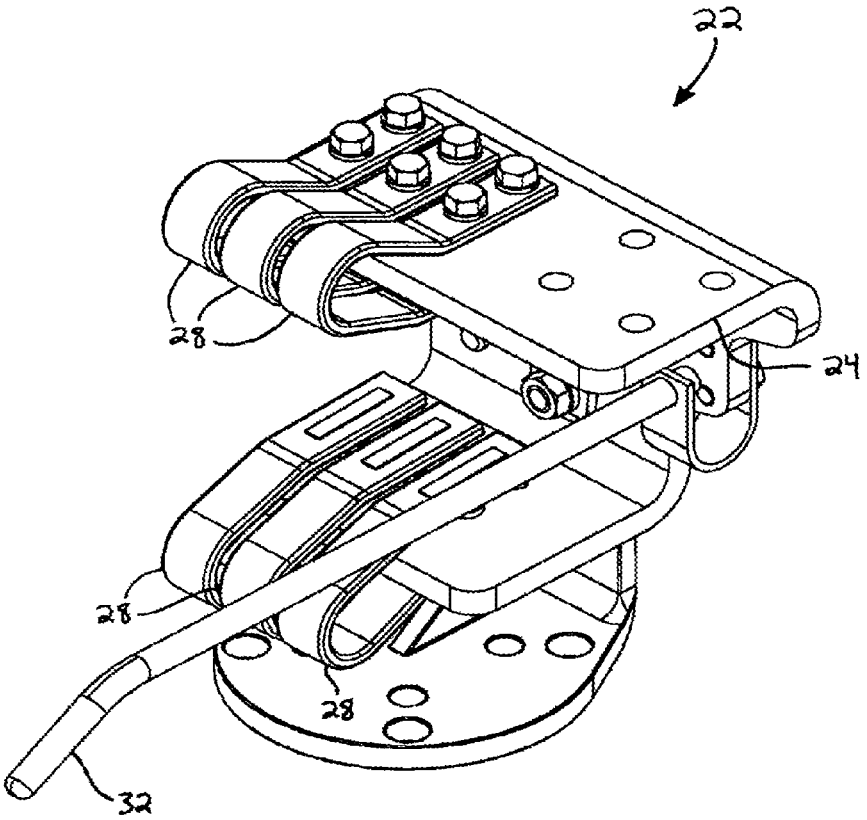
FIG. 6 is a perspective view of one of the electrical terminals of the air break switch.
Figure 7:
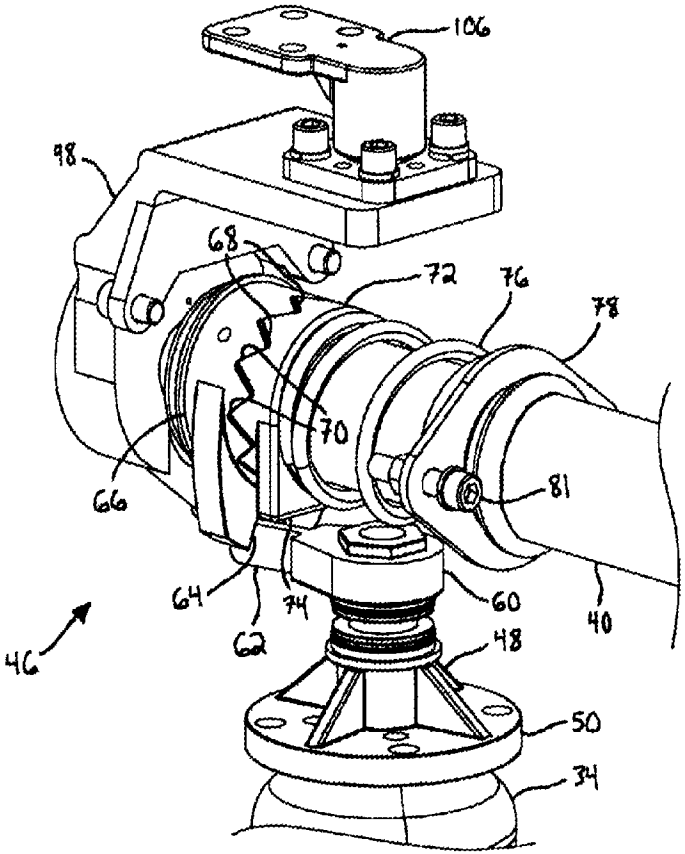
FIG. 7 is a perspective view of a toggle mechanism of the switch in the closed contact position of FIG. 1 with a blade support housing removed for clarity.

Referring now to FIGS. 1, 4, 5 and 7-10, the blade support 38 mounts the blade 40 such that the blade 40 is pivotable about its longitudinal axis from a closed contact position (FIG. 4) to an open contact position (the blade 40 is shown moving toward the open contact position in FIG. 5) and vice versa. As the name implies, in the closed contact position contacts 42 on the end of the blade 40 proximate the first electrical terminal 22 engage the terminal contacts 28 to electrically connect the first terminal 22 and the blade 40. Conversely, in the open contact position the blade contacts 42 disengage the terminal contacts 28, although the first electrical terminal 22 and the blade 40 may still be electrically connected by contact between the first arcing arm 32 and a second arcing arm 44 supported by the blade 40.

Figure 9:
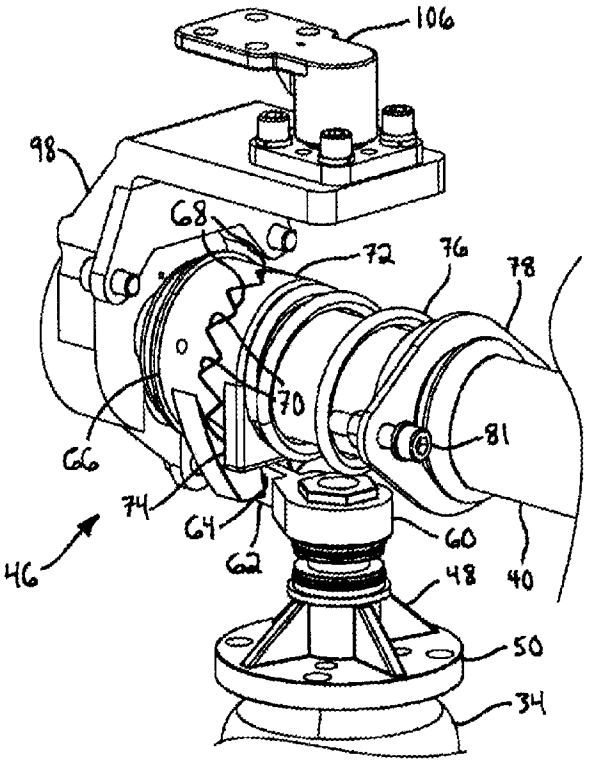
FIG. 9 is a perspective view of the toggle mechanism in the open contact position with the blade support housing removed for clarity.
Figure 10:
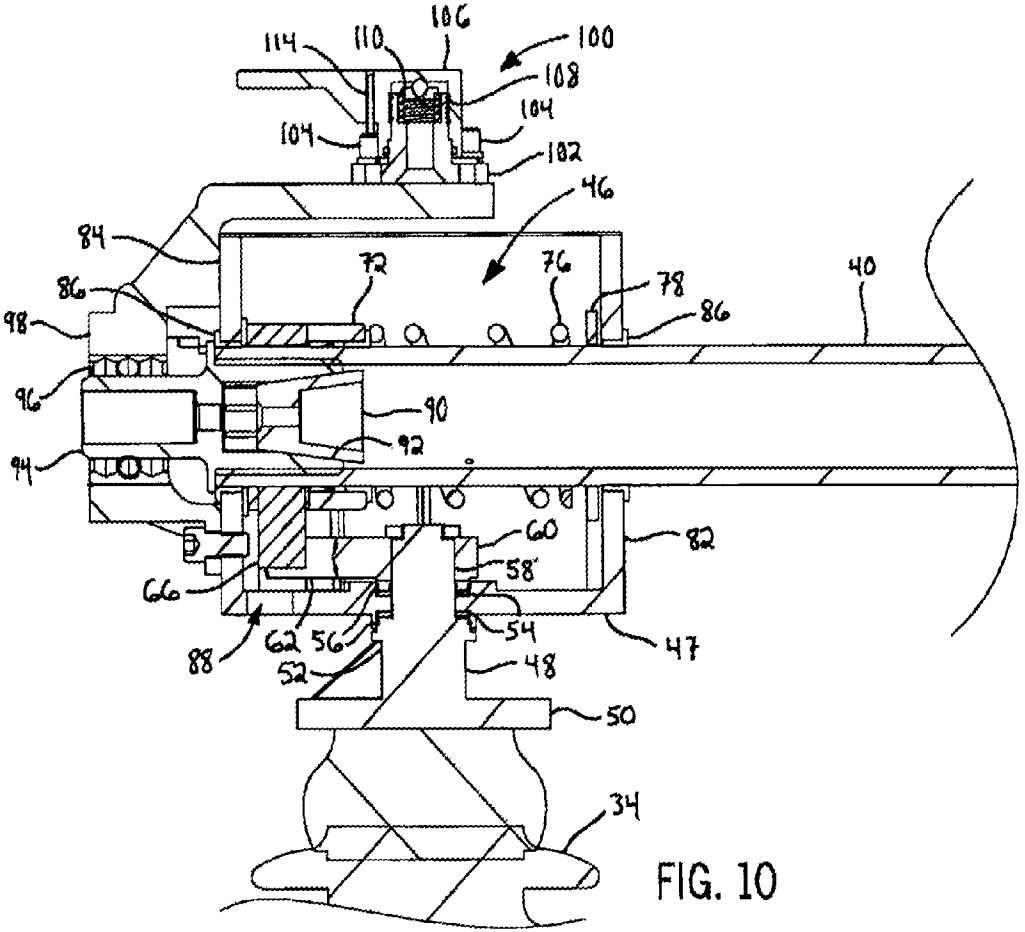
FIG. 10 is a sectional view of the toggle mechanism and the blade in the open contact position.
Figure 11:
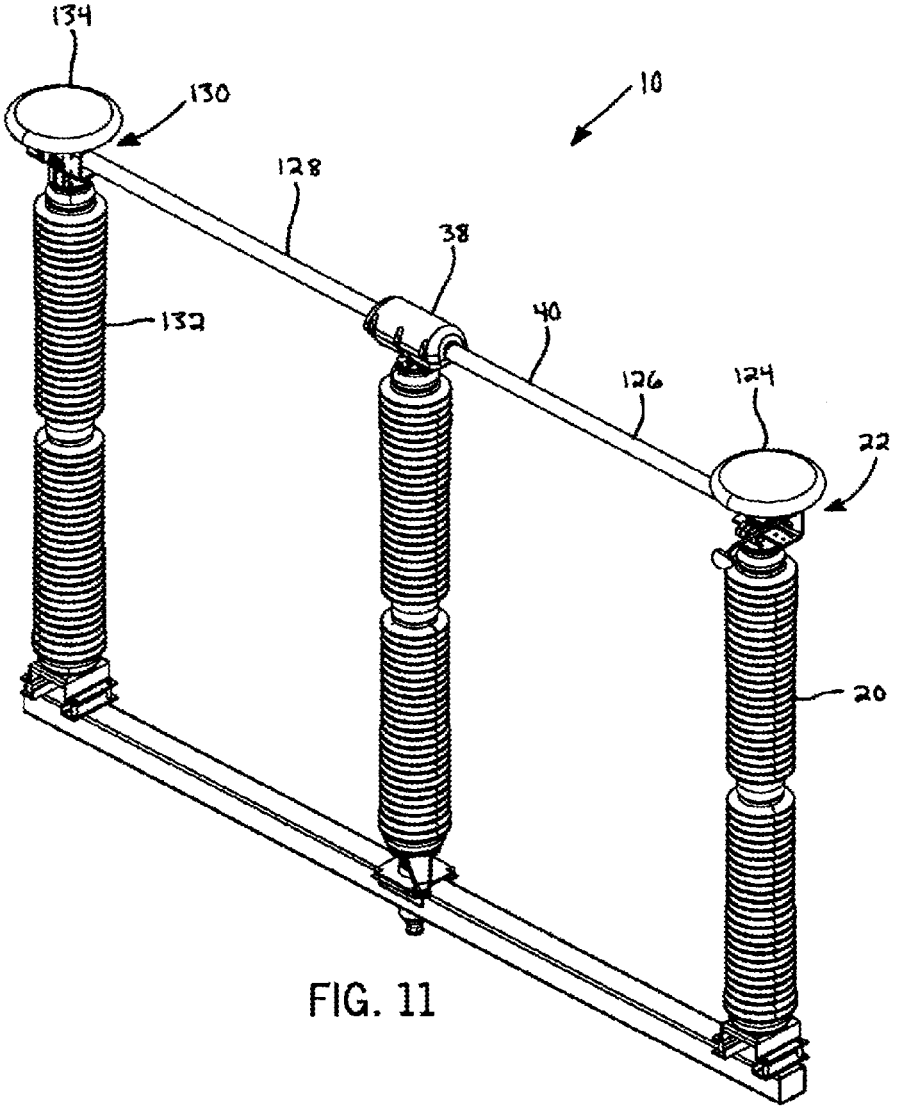
FIG. 11 is a perspective view of a second embodiment of the air break switch of the present invention in a closed blade position and a closed contact position.
Figure 12:
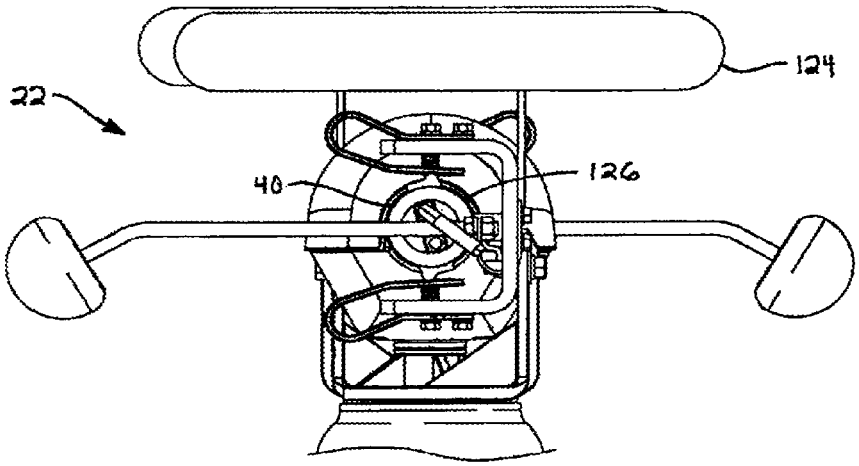
FIG. 12 is a side view of the air break switch of FIG. 11 illustrating a first electrical terminal.
Figure 13:
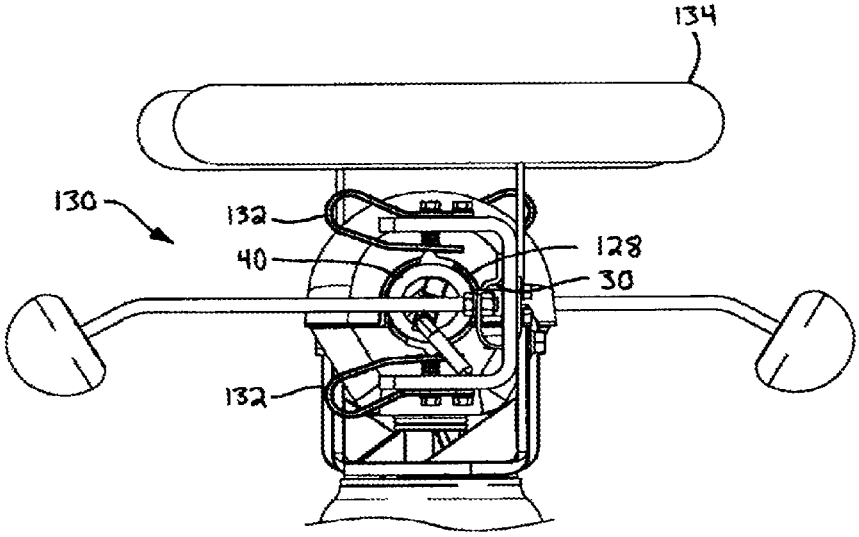
FIG. 13 is a side view of the air break switch of FIG. 11 illustrating a second electrical terminal opposite the first electrical terminal.
Figure 14:
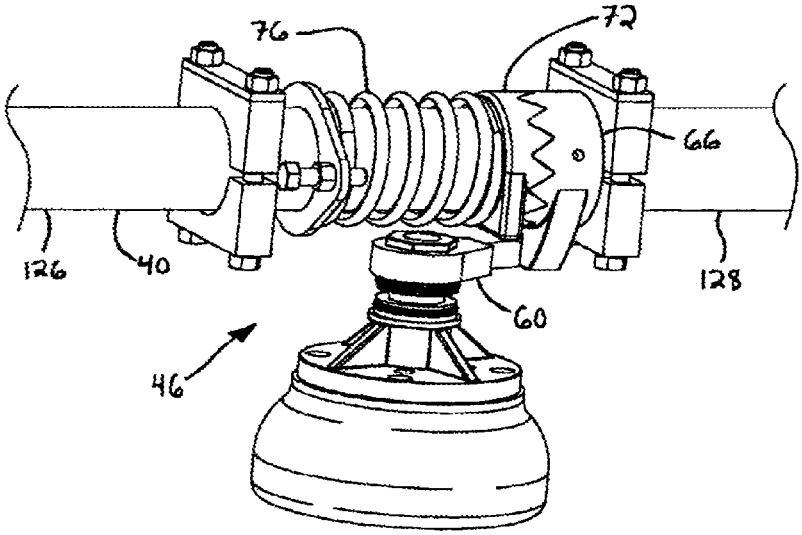
FIG. 14 is a perspective view of a toggle mechanism of the air break switch of FIG. 11 with a blade support housing removed for clarity.
Figure 15:
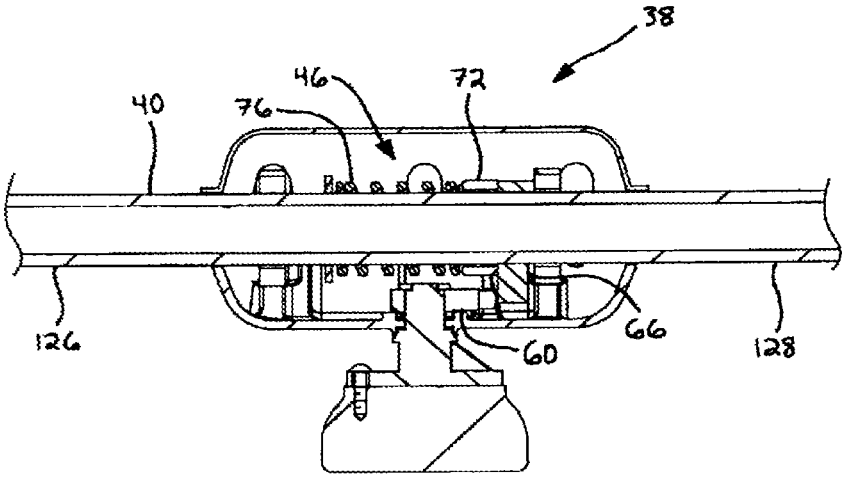
FIG. 15 is a sectional view of the toggle mechanism of FIG. 14 and a blade of the air break switch.

To facilitate the pivotal motion of the blade 40 described in the previous paragraph, the blade support 38 includes a toggle mechanism 46 (FIGS. 7-10) that connects to a blade support housing 47 (FIG. 10). The toggle mechanism 46 includes a rotator 48 fixedly connected to the second insulator 34, e.g., via fasteners (not shown) extending through a rotator mounting flange 50. As such, the rotator 48 pivots with the second insulator 34 when it is driven by the operating mechanism 16. The rotator 48 also includes a rotator coupling section 52 (FIG. 10) above the mounting flange 50. The rotator coupling section 52 supports two bearings 54 and seals 56, and as such, the rotator coupling section 52 rotatably supports the blade support housing 47. In addition, the rotator 48 includes a keyed coupling section 58 (FIG. 10) above the rotator coupling section 52. The keyed coupling section 58 engages a cam or toggle lever 60 via one or more keys (not shown), and as such, the toggle lever 60 pivots with the rotator 48 and the second insulator 34 when they are driven by the operating mechanism 16.

The toggle lever 60 includes a pin 62 that extends away from the first electrical terminal 22. The pin 62 engages a slot 64 (FIG. 7) of a first toggle or over-center member 66 that fixedly surrounds the blade 40 and connects thereto, e.g., via fasteners (not shown). The first toggle member 66 has a crown shape with a first set of crown points 68 disposed at one end. The first set of crown points 68 engages and interdigitates with a second set of crown points 70 of a second toggle or over-center member 72. The second toggle member 72 is translatably and pivotally supported by the blade 40; however, the second toggle member 72 includes a flange 74 that contacts an interior wall of the blade support housing 47 to inhibit the second toggle member 72 from rotating relative to the housing 47. The second toggle member 72 is also biased into engagement with the first toggle member 66 by a compression spring 76 disposed between the second toggle member 72 and a housing bracket 78. The interactions between the first toggle member 66, the second toggle member 72, and the spring 76, and their effect on motion of the blade 40, are described in further detail in the following paragraph.

Figure 2:
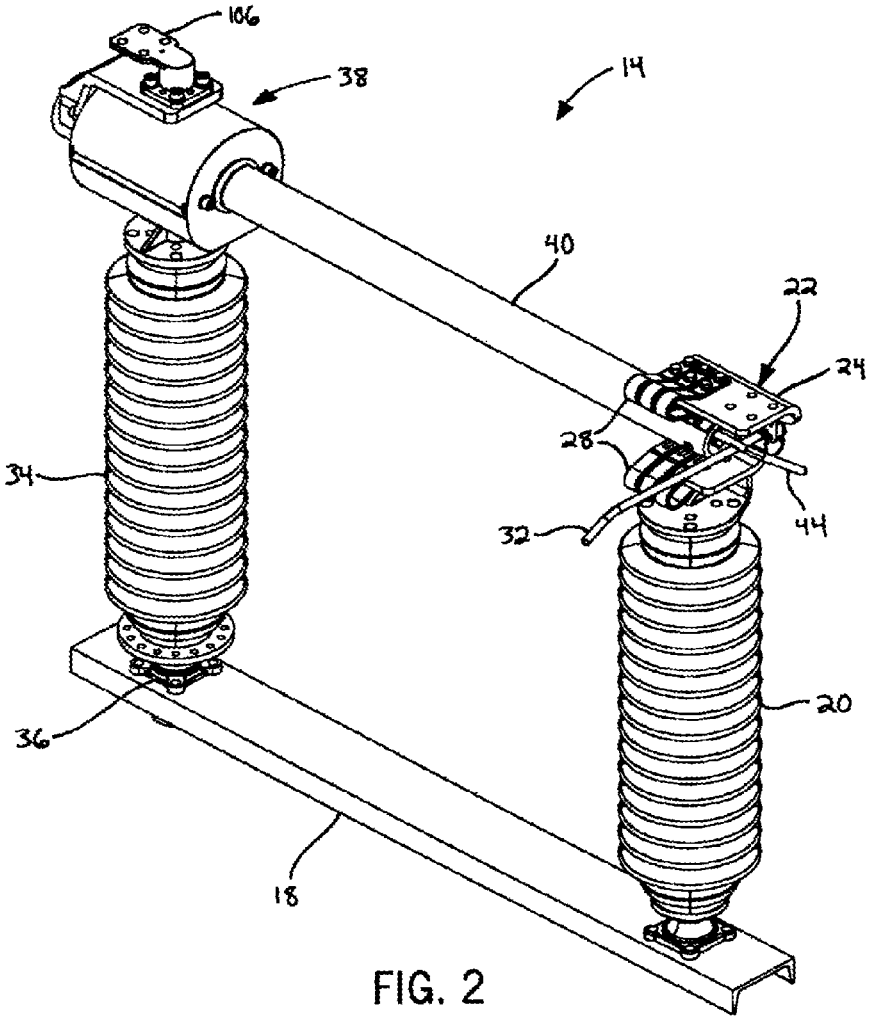
FIG. 2 is a perspective view of the air break switch of FIG. 1 with the blade pivoting to an open contact position in which the terminals are still electrically connected.
Figure 3:
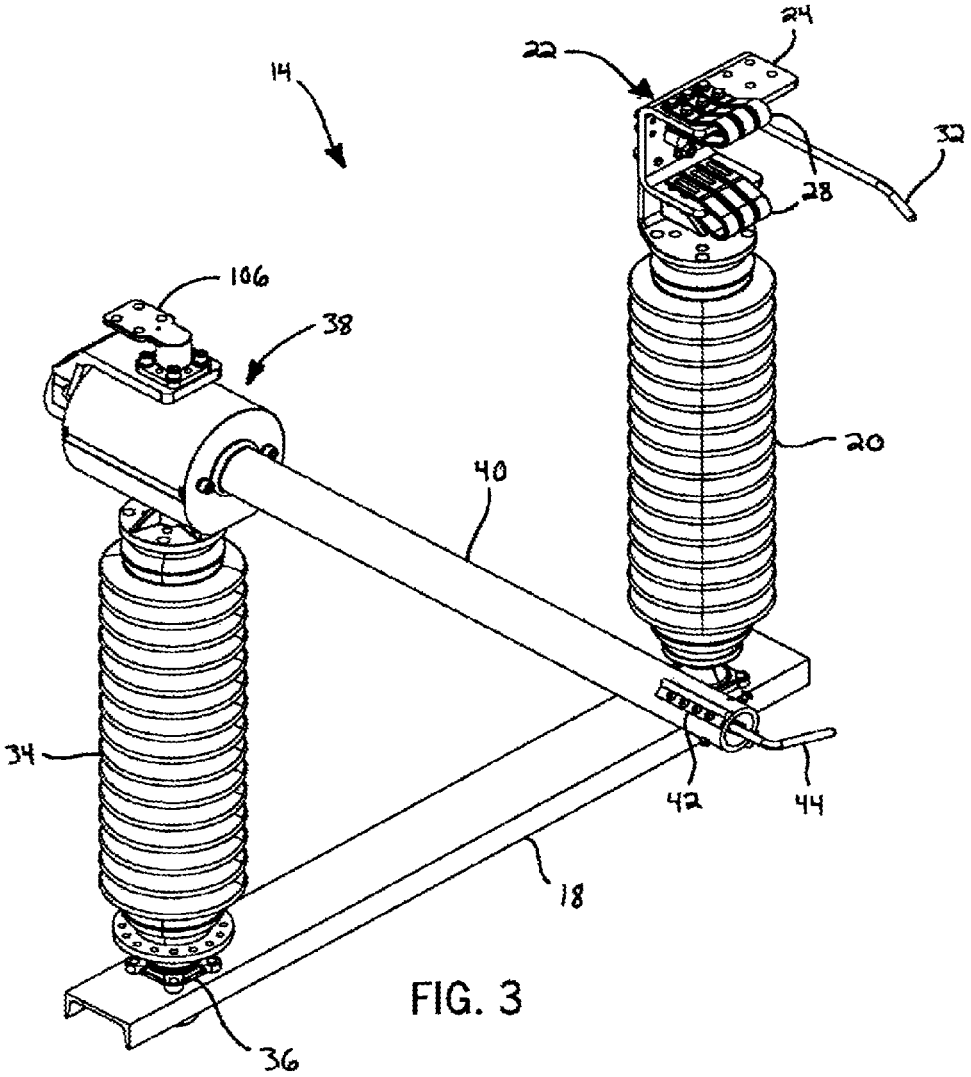
FIG. 3 is a perspective view of the air break switch of FIG. 1 with the blade pivoted to an open blade position in which the terminals are electrically isolated.
Figure 4:
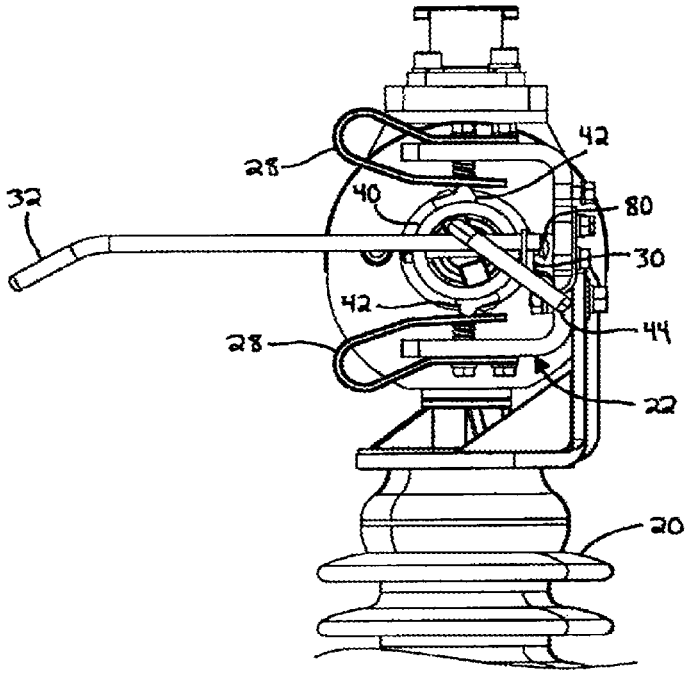
FIG. 4 is a side view of the air break switch in the closed blade position and closed contact position of FIG. 1.
Figure 8:
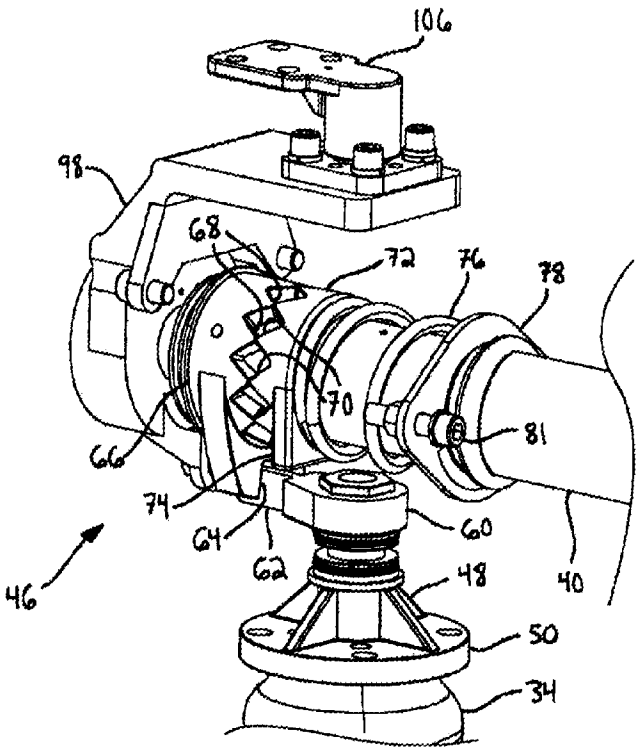
FIG. 8 Is a perspective view of the toggle mechanism moving toward the open contact position with the blade support housing removed for clarity.

If the blade 40 is in the open blade position and the open contact position (i.e., the configuration shown in FIG. 3), clockwise motion of the operating mechanism 16 tends to pivot the toggle lever 60 (FIG. 9) in a counter-clockwise direction. This motion of the toggle lever 60 tends to pivot the first toggle member 66 and the blade 40 about both the vertical axis (about which the toggle lever 60 pivots) and the longitudinal axis of the blade 40. However, the torque needed to pivot the first toggle member 66 and the blade 40 about its longitudinal axis is relatively high due to the pivotally fixed relationship of the second toggle member 72 to the blade support housing 47, engagement of the first and second sets of crown points 68 and 70, and the spring 76. The torque needed to pivot the first toggle member 66 and the blade 40 about the vertical axis is relatively low and, as such, the blade 40 first pivots to the closed blade position (FIG. 2). Upon reaching the closed blade position, the torque needed to pivot the blade 40 about the vertical axis increases significantly due to contact between the blade 40 and the first electrical terminal 22. As such, continued clockwise motion of the operating mechanism 16 causes the first toggle member 66 and the blade 40 to pivot about the longitudinal axis as the first set of crown points 68 slip over the second set of crown points 70 (FIG. 8). After the crown points 68, 70 pass "over center" (i.e., past a position in which the tips contact each other), the spring 76 forces the second toggle member 72 toward the first toggle member 66. This action causes the first and second crown points 68, 70 to interdigitate in a configuration (FIG. 7) different than the previous configuration. In addition, the blade contacts 42 engage the terminal contacts 28 (i.e., the blade 40 enters the closed contact position).

A simple latching mechanism inhibits the blade 40 from returning directly to the open blade position (FIG. 3) after entering the closed contact position. In particular and as shown most clearly in FIGS. 4 and 5, the latching mechanism includes a bolt 80 supported at the same end of the blade 40 as the blade contacts 42. The shank of the bolt 80 is sized to enter a slot of the lock bracket 30 of the first terminal 22 as the blade 40 pivots to the closed contact position. However, the head of the bolt 80 is oversized relative to the slot. As such, the bolt 80 engages the bracket 30 and thereby inhibits the blade 40 from pivoting about the vertical axis (i.e., toward the open blade position) before it pivots about its longitudinal axis.

To return the blade 40 to the open contact position and the open blade position, the operating mechanism 16 is pivoted in a counter-clockwise direction to pivot the toggle lever 60 (FIG. 7) in a clockwise direction. This motion of the toggle lever 60 tends to pivot the first toggle member 66 and the blade 40 about both the vertical axis and the longitudinal axis of the blade 40. However, the blade 40 does not immediately pivot about the vertical axis due to engagement of the bolt 80 and the lock bracket 30 as described above. As such, the first toggle member 66 and the blade 40 first pivot about the longitudinal axis as the first set of crown points 68 slip over the second set of crown points 70 (FIG. 8). After the crown points 68, 70 pass over center, the spring 76 forces the second toggle member 72 toward the first toggle member 66. This action causes the first and second crown points 68, 70 to interdigitate in their original configuration (FIG. 9). In addition, the blade contacts 42 disengage the terminal contacts 28 (i.e., the blade 40 enters the open contact position) and the bolt 80 disengages the lock bracket 30. As such, continued counter-clockwise motion of the operating mechanism 16 pivots the blade 40 about the vertical axis (i.e., toward the open blade position).

In order to ensure the toggle mechanism 46 does not force the blade 40 to return to the closed contact position when the operating mechanism 16 is pivoted in a counter-clockwise direction, the spring-biased terminal contacts 28 preferably remain in engagement with the blade contacts 42 until the toggle mechanism 46 passes over center. That is, friction between the terminal contacts 28 and the blade contacts 42 holds the blade 40 in the closed blade position until the blade 40 pivots from the closed contact position and the toggle mechanism 46 passes over center. Conversely, if the terminal contacts 28 were to disengage the blade contacts 42 before the toggle mechanism 46 passed over center, the blade 40 would begin to pivot vertically due to motion of the operating mechanism 16, but the second toggle member 72 and the compression spring 76 would force the blade 40 to pivot back to the closed contact position.

The spring constant of the compression spring 76 may be selected to provide an appropriate torque threshold to be exceeded to pivot the blade 40 about its axis. An appropriate torque threshold is higher than the torque needed to pivot the blade 40 about the vertical axis but preferably not so high that an operator cannot easily apply the torque to the operating mechanism 16. Additionally, the housing bracket 78 may be adjustable (e.g., by turning fasteners 81) to vary the force applied by the second toggle member 72 to the first toggle member 66.

Referring now specifically FIG. 10, the remainder of the blade support 38 will be described. The blade support housing 47 includes front and rear walls 82 and 84 that pivotally support the blade 40 via bushings 86. The blade support housing 47 also includes a drain hole 88 that prevents moisture from accumulating within the blade support housing 47.

The blade 40 is attached internally to a blade end cap 90. A proximal portion 92 of the blade end cap 90 is outwardly expandable to ensure that the blade end cap 90 and the blade 40 remain in contact and electrically connected. A distal portion 94 of the blade end cap 90 is surrounded and contacted by one or more current transfer springs 96. The current transfer springs 96 are disposed within a terminal support 98.

The terminal support 98 mounts a second electrical terminal 100 above the blade support housing 47. The second electrical terminal 100 includes a terminal mounting 102 that fixedly connects to the terminal support 98 via fasteners 104. The terminal mounting 102 pivotally supports a conductor contact 106 via a threaded connection 108. A compression spring 110 disposed within the terminal mounting 102 biases the conductor contact 106 to ensure the terminal mounting 102 and the conductor contact 106 remain in contact and electrically connected through the threaded connection 108. The conductor contact 106 is pivotable relative to the terminal mounting 102 via the threaded connection 108 to reduce stress on another electrical conductor, such as a transmission wire 112 (FIG. 1), connected to the conductor contact 106. However, the range of motion of the conductor contact 106 is limited by a pin 114 that contacts the fasteners 104.

Referring again to FIG. 1, the operating mechanism 16 will now be briefly described in further detail. The operating mechanism 16 includes a bracket 116 fixedly connected to the second insulator 34. The bracket 116 pivotally connects to and is driven by an elongated link 118. The elongated link 118 pivotally connects to and is driven by a short link 120. The short link 120 fixedly connects an elongated vertical shaft 122 that extends from the upper switch 14 toward the ground.

The switch 10 may comprise appropriate materials recognized by those skilled in the art. For example, the blade 40 may comprise aluminum and the terminals 22 and 100 and the blade support 38 may comprise copper, silver-coated metals, or the like. The insulators 20 and 34 may comprise ceramics.

Referring now to FIGS. 11-15, a second embodiment of an air break switch 10 according to the present invention is shown. The second embodiment of the switch 10 has similarities to the embodiment described above. For example, the switch 10 includes a first electrical terminal 22 supported by a first insulator 20. In addition to the components described above, the terminal 22 includes a corona shield 124. The first electrical terminal 22 electrically connects to a proximal end 126 of a blade 40 that is supported by a pivotable blade support 38. The blade support 38 also supports a toggle mechanism 46 that inhibits the blade 40 from pivoting to the closed contact position before pivoting to the closed blade position. To facilitate this motion of the blade 40, the toggle mechanism 46 includes a toggle lever 60 that pivots a first toggle member 66, and the first toggle member 66 slips relative to a second toggle member 72 as described above. In addition, the second toggle member 72 is biased toward the first toggle member 66 by an adjustable compression spring 76.

Unlike the embodiment described above, however, the blade support 38 does not support a second electrical terminal. Instead, a distal end 128 of the blade 40 extends away from the first electrical terminal 22 and toward a second electrical terminal 130 supported by a third insulator 132. Besides facing the opposite direction to receive the distal end 128 of the blade 40, the second electrical terminal 130 is generally similar to the first electrical terminal 22 (e.g., the second electrical terminal 130 includes terminal contacts 132 and a corona shield 134). Furthermore, the lock bracket 30 on the second electrical terminal 130 faces downward. This construction is as such because, as viewed in FIGS. 12 and 13, the ends of the blade 40 rotate in opposite directions (although the ends 126, 128 of the blade 40 actually rotate in the same direction) to enter the closed contact position.

For both embodiments described above, it should be apparent that the electrical conductors (e.g., transmission wires 26 and 112) connected to the first and second electrical terminals are selectively electrically connectable by engaging and disengaging the blade from the first electrical terminal (in the case of the first embodiment) or both terminals (in the case of the second embodiment). Furthermore, the toggle mechanism inhibits the blade from pivoting about its own axis before pivoting proximate the first electrical terminal or both of the electrical terminals.

Preferred embodiments of the invention have been described in considerable detail. Many modifications and variations to the preferred embodiments described will be apparent to a person of ordinary skill in the art. Therefore, the invention should not be limited to the embodiments described, but should be defined by the claims that follow.

I claim:

1. An electrical switch, comprising:

an electrical terminal including a terminal contact;

a blade supported by a blade support and having a blade contact, the blade rotatable about a first axis from an open blade position to a closed blade position and rotatable about a second axis from an open contact position to a closed contact position; and a toggle mechanism operatively connected to the blade to rotate the blade from the open contact position to the closed contact position, wherein the blade contact engages the terminal contact in the closed contact position; wherein the toggle mechanism includes a first toggle member and a second toggle member; wherein the toggle mechanism includes a toggle lever operatively connected to the first toggle member.

2. The electrical switch of claim 1, wherein the first toggle member displaces the second toggle member when the blade is rotated to the closed contact position.

3. The electrical switch of claim 1, wherein the blade support is rotatably connected to a frame by a bearing assembly.

4. The electrical switch of claim 1, further comprising a second electrical terminal, wherein the blade rotates about the first axis to engage the first and second electrical terminals.

* * * * *